US005913531A

United States Patent [19]

Buquet

[11] Patent Number: 5,913,531

[45] Date of Patent: Jun. 22, 1999

[54] RELEASABLE BINDING FOR SKI, MONOSKI, SNOWBOARD OR THE LIKE

[75] Inventor: Thierry Buquet, Varennes Vauzelles, France

[73] Assignee: Look Fixations SA, Nevers, France

[21] Appl. No.: 08/760,707

[22] Filed: Dec. 5, 1996

[30] Foreign Application Priority Data

Dec. 8, 1995 [FR] France ..... 95 15194

[51] Int. Cl.[6] ..... A63C 9/10

[52] U.S. Cl. ..... 280/626; 280/623

[58] Field of Search ..... 280/623, 611, 280/626, 631, 632, 634

[56] References Cited

U.S. PATENT DOCUMENTS

| | | | |
|---|---|---|---|
| 4,625,991 | 12/1986 | Leichtfried | 280/632 |
| 4,681,338 | 7/1987 | Spitaler | 280/628 |
| 4,984,816 | 1/1991 | Rullier | 280/625 |
| 5,005,854 | 4/1991 | Szafranski | 280/626 |

FOREIGN PATENT DOCUMENTS

| | | |
|---|---|---|
| 2200768 | of 0000 | Germany . |
| 33 22634 A1 | of 0000 | Germany . |
| WO 87/06485 | of 0000 | WIPO . |

*Primary Examiner*—J J Swann
*Assistant Examiner*—David R. Dunn
*Attorney, Agent, or Firm*—Fay, Sharpe, Beall, Fagan, Minnich & McKee, LLP

[57] ABSTRACT

A binding holds a ski boot in a releasable manner to a ski or the like. A jaw (3) is pivotally mounted on a body (2) around a transverse axle (4), such that it is rotatably movable from a closed position to an open position and vice versa. The jaw (3) is held in a closed position by a biasing system. The binding also includes a loosening lever (11) pivotally movable around the transverse axle (4), such that it is movable from a position in which it extends towards the top, corresponding to the closed position of the jaw, and an open position in which it extends towards the rear, corresponding to the open position of the jaw. The biasing system includes a piston (6) which is longitudinally moved by action of a spring (7) pressing on a ramp (8,9) defined in the jaw (3). The piston is constrained at least toward the top by at least one restraining stub axle **(14, 14*a*, 14*b*, 140, 140') jointed to the piston (16) at its upper end by an axle (12) and to the body (2) at its lower end by a transverse axle (15)**.

11 Claims, 11 Drawing Sheets

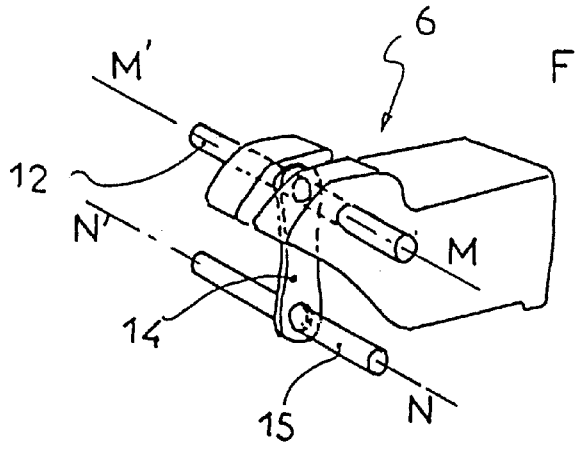
FIG 21
FIG 22
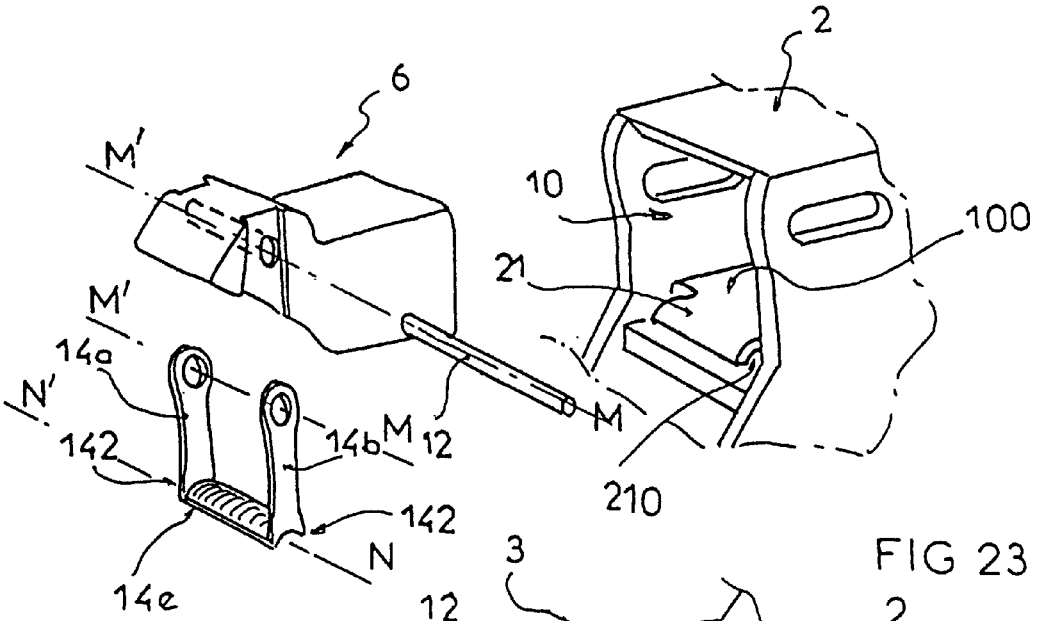
FIG 23
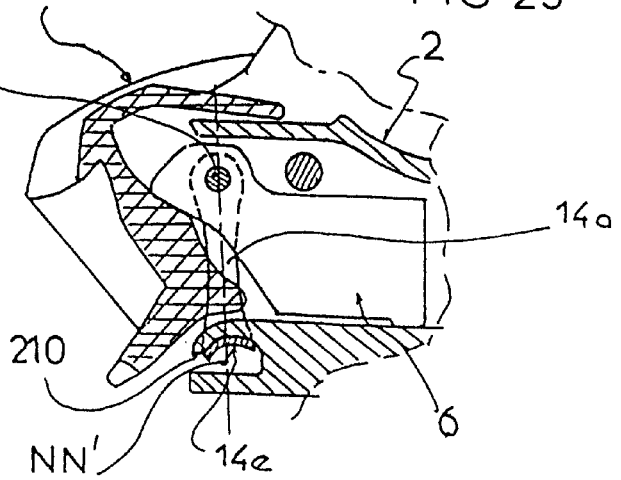

RELEASABLE BINDING FOR SKI, MONOSKI, SNOWBOARD OR THE LIKE

BACKGROUND OF THE INVENTION

The invention concerns a binding device of a ski boot to a gliding board, such as a ski or the like, as, for example, a monoski, snowboard or other. Such a device being generally referred to in the ski business as a "binding."

The invention concerns more particularly a device intended to restrain the back of the boot of a user in a releasable manner which is more commonly called a "heel binding."

It is already well-known the numerous bindings intended to hold a ski boot on a ski in order to permit, on one hand, the convenience of skiing, and on the other hand, the release of the said boot when it appears that the leg of the skier is in danger. Such bindings includes a jaw pivoting when prompted by an elastic system, while a loosening lever permits the user to open the jaw in order to permit the voluntary release of his boot.

One can note, for example, the heel bindings described in French Patent Nos. 2,492,668, 2,338,060, 2,494,591 and 2,717,400. In all of these systems, one finds an elastic system constituted by a sliding instrument, prompted by the pressure of a spring on a release ramp, the ramp being achieved in the interior of the restraining jaw, the said ramp being extended toward the base by a second ramp, the said opening ramp, which permits the jaw to be held in an open position. These bindings, having been already improved, present a number of inconveniences, notably that of not being reliable and supplying, as to precise spring compression, variable release stress which, in certain cases, can be dangerous for the skier who has total trust in his equipment. These release variations are due in large part to undesirable interfering effects such as bending of the movable instrument and rubbing of the latter on its runner housing at the time of its transfer.

The present invention seeks to remedy known inconveniences of traditional bindings and suggests a new restraining device particularly simple and reliable.

SUMMARY OF THE INVENTION

This goal is presently achieved by a means to restrain the end of the movable locking instrument towards the base, this means being constituted by at least one stub axle jointed, on one hand, on the sliding instrument and, on the other hand, on the body of the binding.

According to another characteristic of the invention, the loosening lever is jointed on the piston on the same joint axle of the one or more restraining stub axles.

In a favorable arrangement, the sliding piston includes two lateral stub axles extending toward the base, while in one of the methods of operation, the two stub axles are connected at their upper ends by a cross-piece to form a stirrup in the form of a U open at the bottom.

Thus, according to the invention, the binding is intended to hold a boot to a ski or the like in a releasable manner, and is of the type including a jaw pivotally mounted on a body around a transverse axle, such that it can be moved from a closed position to an open position and vice versa, the said jaw being held in a closed position by an elastic system, the binding including moreover a loosening lever pivotally movable around a transverse axle, such that it can be moved from a position in which it extends towards the top to an open position in which it extends towards the rear, the said elastic system including a piston which can be longitudinally transferred when prompted by spring pressure against a ramp, achieved in the jaw, and is characterized in that the piston is restrained towards the top by at least one restraining stub axle jointed on the body by the its lower end around a transverse axle.

According to an additional characteristic, the restraining stub axle is jointed by its upper end around a transverse axle on the front part of the piston.

According to a preferred embodiment, the piston includes two lateral restraining stub axles laterally arranged on either side of the piston, while the general axle of each stub axle joining the centers of the two axles extends approximately vertically to be advantageously in the closed position, the axle sloped slightly forwards and towards the top to form an acute angle with the vertical, while in the open position, the axle is sloped slightly towards the rear and towards the top to form an acute angle with the said vertical.

According to another preferred embodiment, the two lateral stub axles are arranged in lateral releases achieved in the side surfaces of the piston.

In a variation of operation, the two lateral restraining stub axles are connected by their upper ends by a cross-piece to form a restraining stirrup having the form of a U open at the bottom.

According to another characteristic of the invention, the loosening lever is jointed on the piston around the transverse axle, to which is already jointed the one or more restraining stub axles.

The piston includes a rear part including a central hole intended to receive the spring, extended forwards by a front part including a transverse support nose intended to cooperate with the ramp of the jaw, while the said rear part is approximately parallel-piped and its lower wall includes at its end a transverse support projection intended to press slidably on the lower surface of the housing support in which moves the piston.

One will understand that due to the restraining stub axles, the piston will move towards the rear constantly and without reproach, while stress placed on the lever during voluntary release will be perfectly received without the risk of piston deterioration.

BRIEF DESCRIPTION OF THE DRAWINGS

Other characteristics and advantages of the invention will be revealed from the description which follows in view of the attached drawings which are given only to illustrate the invention and not for limitation of same.

FIGS. 1 to 14 illustrate a first method of achievement of a ski binding according to the invention.

FIGS. 1 and 2 are exterior side views of the first method of achievement.

FIG. 1 is a view showing the binding in an open position ready to be shoed.

FIG. 2 is a view showing the same binding in a closed position whereby the boot is restrained.

FIG. 3 is a view from above.

FIG. 4 is a rear view.

FIG. 5 is a cross-sectional longitudinal view of FIG. 2 according to the vertical scale of general symmetry.

FIG. 6 is a cross-sectional view according to VI—VI of FIG. 5.

FIG. 7 is a fragmented view in perspective showing certain details of the operation.

FIG. 8 is a perspective view showing a bottom group constituted by the piston and its restraining stub axles as well as the lever which is mounted on the same axle as the stub axles.

FIG. 9 represents the locking system with its movable piece and spring, the said movable piece being shown in longitudinal cross-section, the two elements of the system being separated.

FIG. 11 is a scale view of a restraining stub axle.

FIGS. 12, 13 and 14 are various views in partial cross-section.

FIG. 12 shows the binding with partial removal of one of the side flanks of the jaw allowing one to view one of the side walls of the lever.

FIGS. 13 and 13*a* are partial views according to XIII—XIII of FIG. 6.

FIG. 13 being an illustration of the binding in a position in which the boot is placed and held in the binding, while FIG. 13*a* represents the binding in a position in which the boot is removed.

FIG. 14 is a view in partial cross-section according to the longitudinal scale (P) of the general symmetry of the binding.

FIG. 15 is a view similar to that of FIG. 7.

FIGS. 16, 17 and 18 are views of details and of the embodiment of the restraining stirrup, FIG. 16 being a front view, FIG. 17 being a side view, while FIG. 18 is a cross-sectional view according to A—A.

FIGS. 19 and 20 are partial schematic views illustrating the operation of the binding and more particularly the operation of the restraining stirrup.

FIG. 21 is an illustration of another variation of the embodiment.

FIGS. 22 and 23 illustrate a variation of the embodiment.

FIG. 22 is a view similar to that of FIG. 7 or 15.

FIG. 23 is a longitudinal cross-sectional view.

FIG. 24 represents the restraining stirrup in perspective.

FIG. 25 is a view similar to that of FIG. 23.

DETAILED DESCRIPTION OF THE PREFERRED EMBODIMENTS

Figure 1:
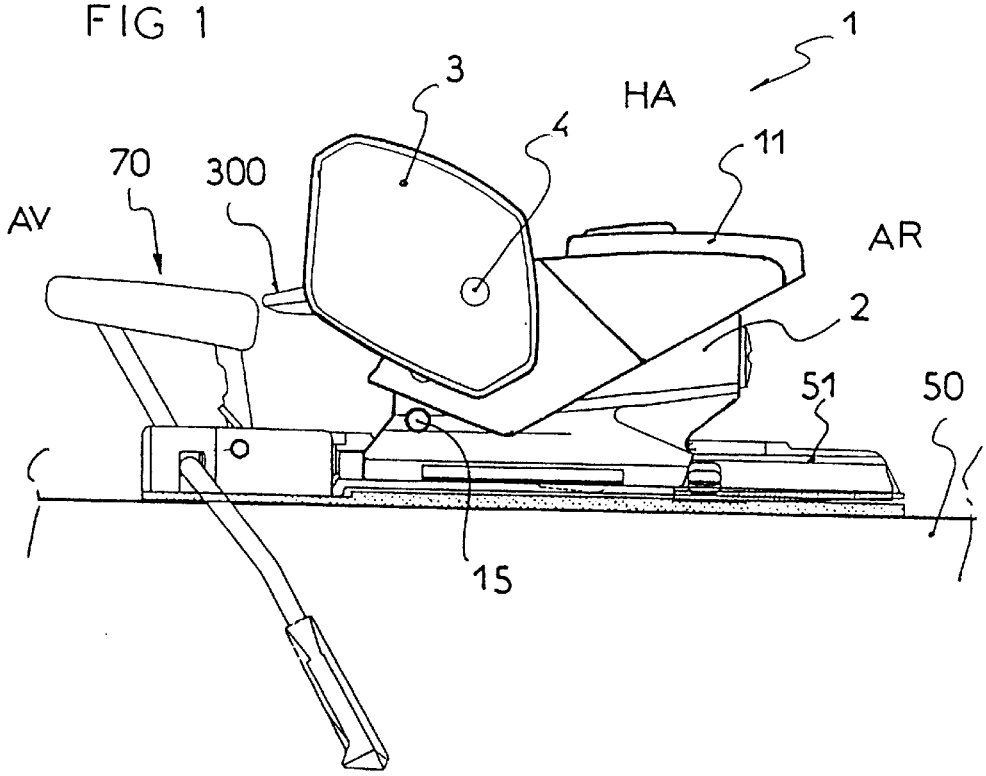

Referring to FIGS. 1–4 a first embodiment of a binding having the general reference (1) intended to hold a boot (40) to a ski (50) in a releasable manner and which is intended to more particularly restrain the back of the boot by its heel. This type of binding being more commonly called a heel binding (1) and includes a vertical plane (P) of general symmetry.

The said heel binding (1) includes a body (2) on which is jointed a restraining jaw (3). In this manner, the latter is mounted on the body pivotally around a transverse axle (4) to be pivotally movable from a position of restraining the boot, such as is illustrated in FIG. 2, to a position of release, such as is shown by FIG. 1, and vice versa.

Figure 2:
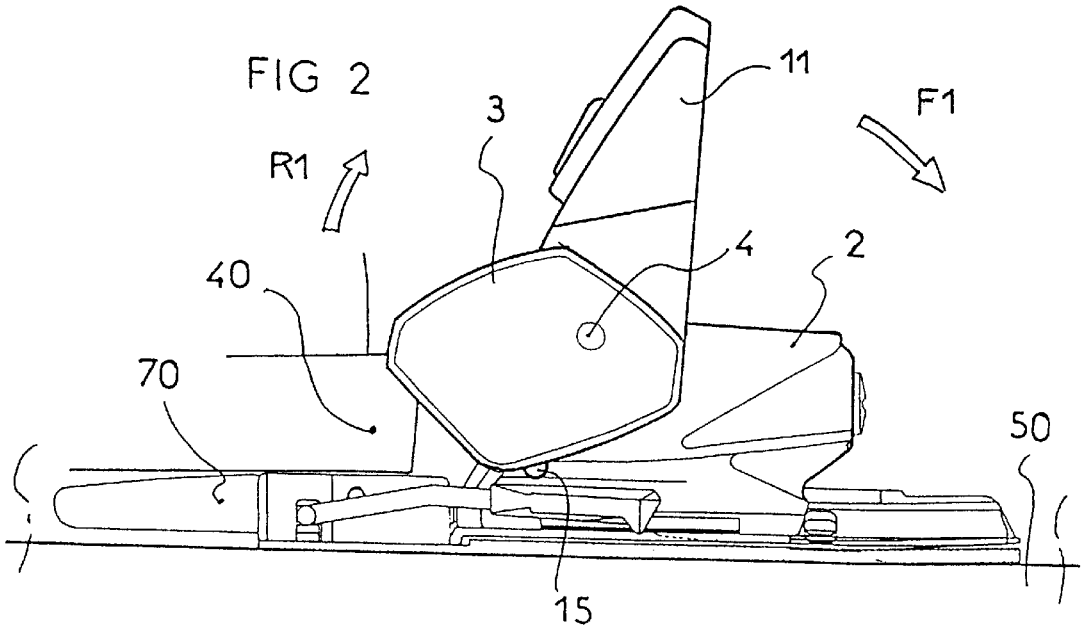
Figure 3:
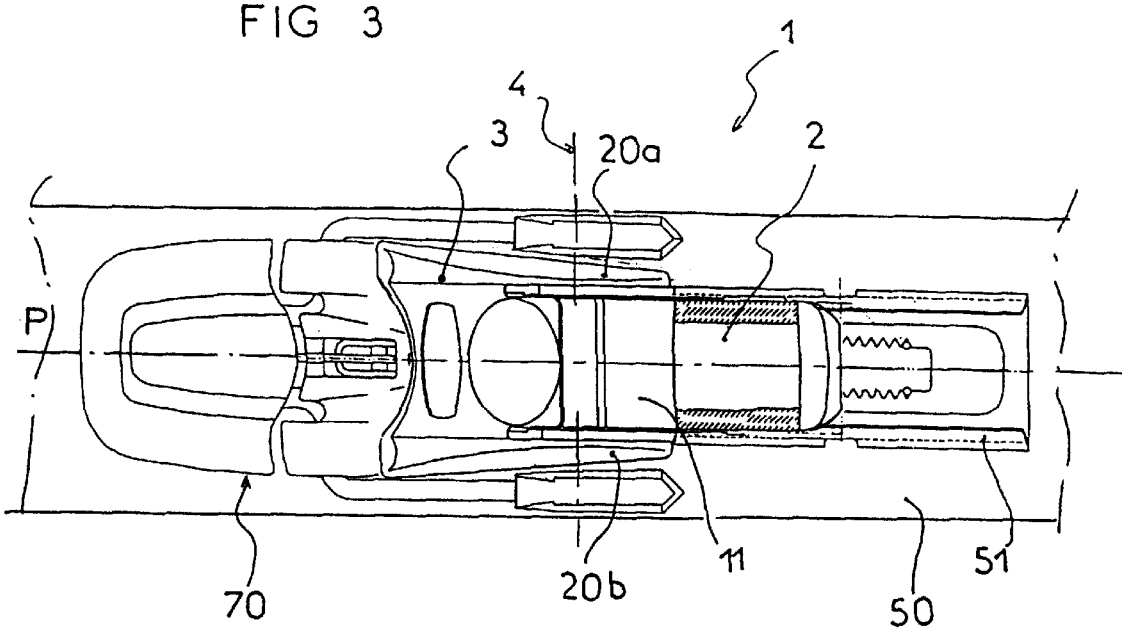
Figure 4:
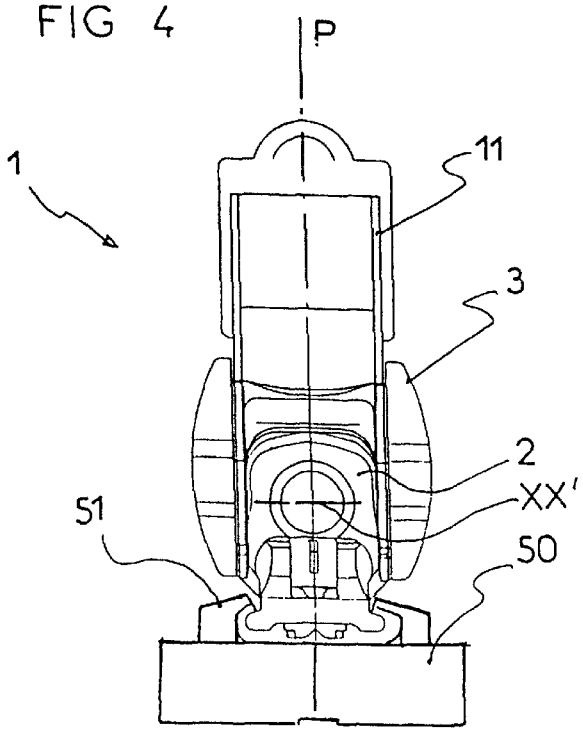
Figure 5:
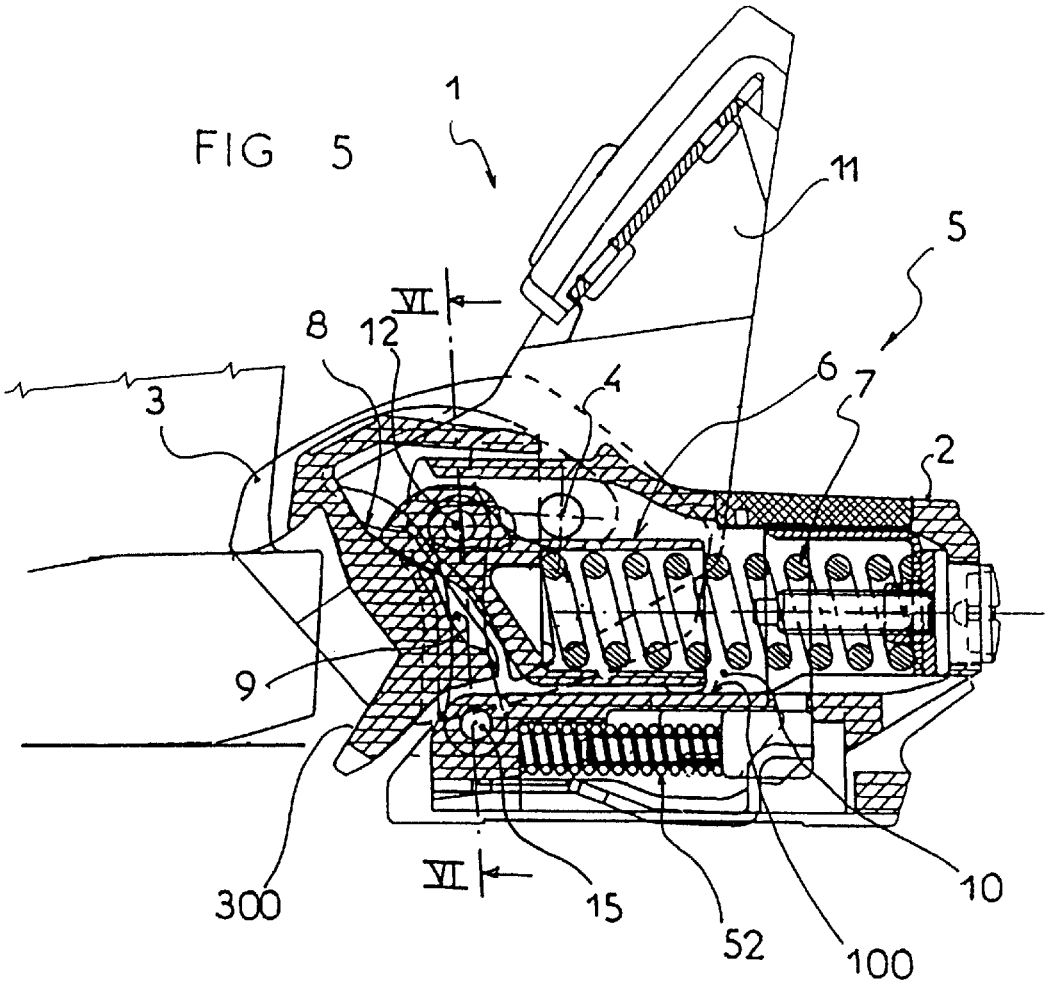
Figure 6:
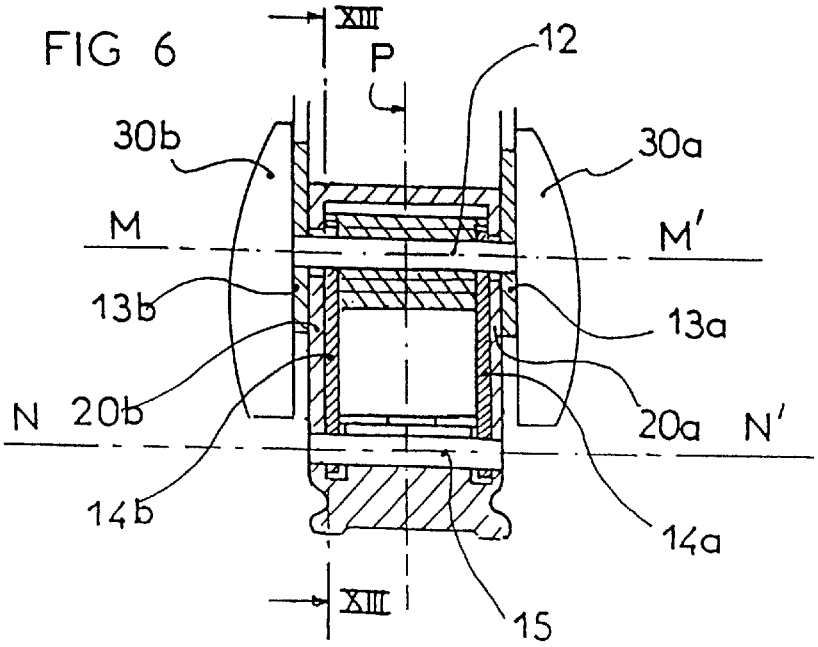

With particular reference to FIGS. 5 and 6, the jaw (3) is prompted to a position of restraining the boot by action of a biasing system (5) constituted by a movable locking element (6) biased by a spring (7) against a release ramp (8), defined in the interior of the jaw (3), the said release ramp (8) being, moreover, advantageously extended toward the base by a second ramp or open ramp (9) permitting the jaw to be able to be placed in a release position and an open position such as is illustrated in FIG. 1.

According to one of the characteristics of the invention, the movable locking element (6) is constituted by a slidably movable piston in transfer, according to the longitudinal axle (XX') of the ski, in the central sliding housing (10) achieved in the body (2) of the binding (1).

Figure 7:
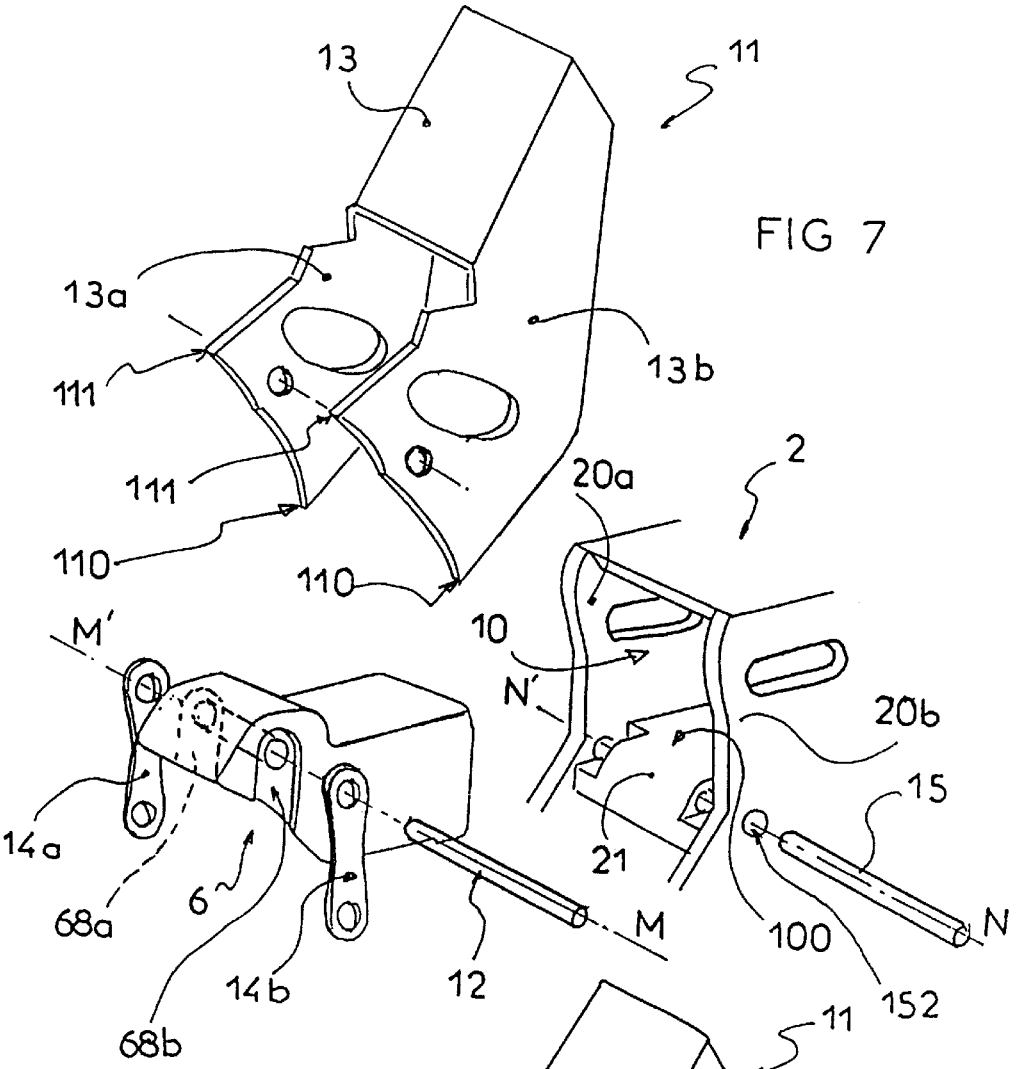
Figure 8:
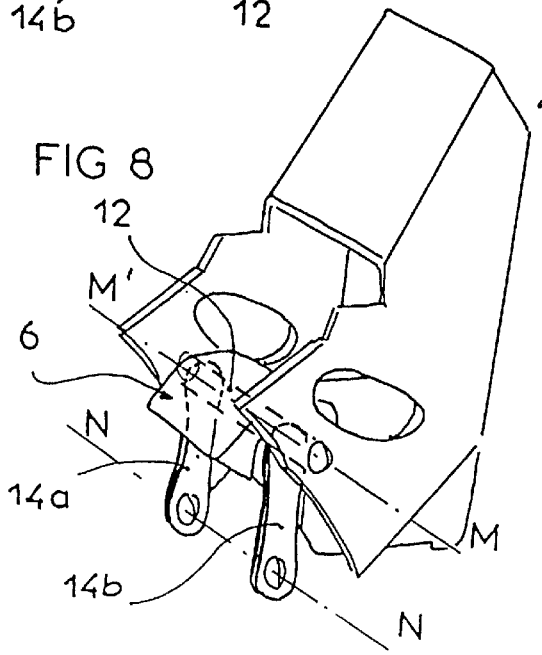
Figure 9:
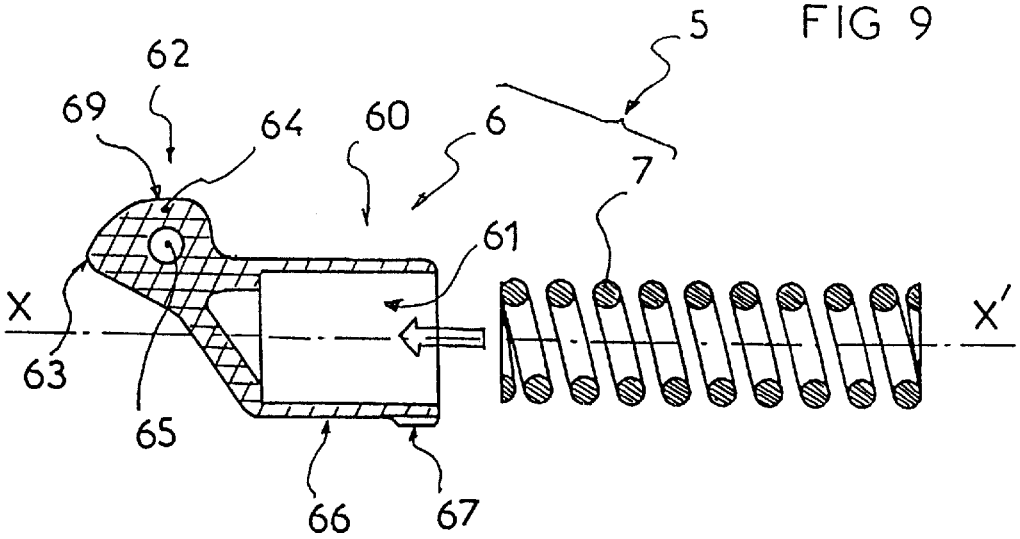
Figure 10B:
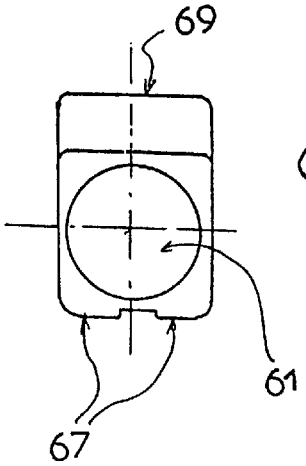
FIGS. 10*a*, 10*b*, 10*c* are views representing the locking piston, FIG. 10*a* being an exterior side view, FIGS. 10*b* and 10*c* being end views.
Figure 10A:
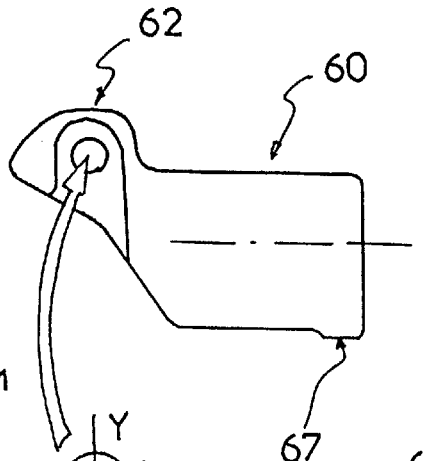
Figure 10C:
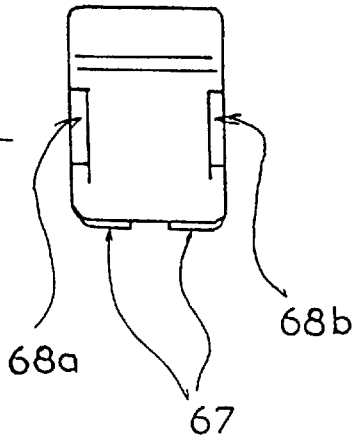
Figure 11:
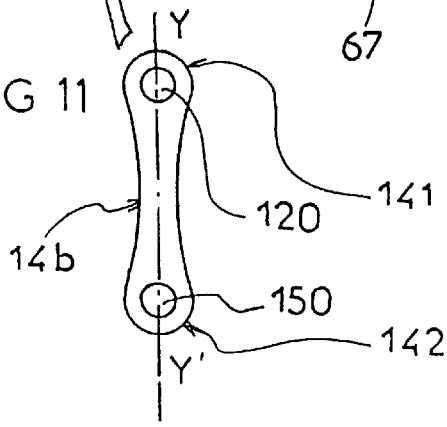
Figure 12:
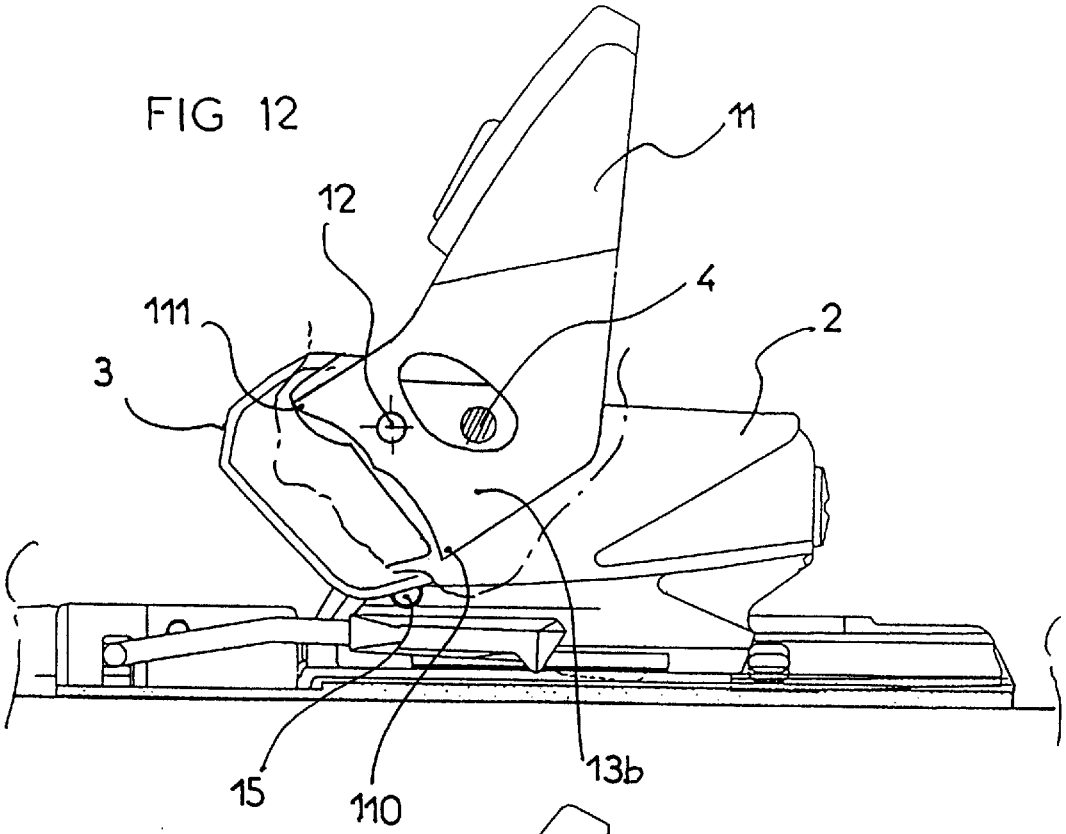

The piston (6) more particularly visible in FIGS. 7, 9 and 10 includes a rear part (60) approximately parallel-piped, including a central longitudinal hole (61) intended to receive the spring (7), extended by a front part (62) including a transverse support nose (63) intended to cooperate with the ramps (8, 9) of the jaw. Furthermore, the said front part (62) includes an upper transverse projection (64) traversed transversely by a transverse hole (65) which receives a pivotal transverse axle (12) whose function will be explained, as well as two lateral releases (68*a*, 6*b*. Also note that the inner wall (66) of the rear part (60) includes at its end a transverse support projection (67).

Moreover, a pivotal loosening lever (11) is anticipated which permits the user to be able to free his boot from the jaw by pivoting the jaw from its restraining position to its release position. Thus, in the restraining position of the jaw, the said lever extends towards the top (HA) to be able to be pivoted towards the rear and towards the base according to FIG. 1 for force open the jaw. In this way, the loosening lever is pivotally mounted on the piston (6) due to the favorable transverse pivotal axle (12), as previously indicated. The said lever (11) is achieved, for example, in steel sheet and includes at least one transverse wall (13) laterally extended by two vertical side walls (13*a*, 13*b*) extending toward the base, whose front ends are arranged between side flanks (30*a*, 30*b*) of the jaw (3) and the corresponding side walls (20*a*, 20*b*) of the body (2) of the tail binding. Furthermore, each of the front ends of the side walls of the lever include, on one hand, at its lower part a loosening projection (110) and, on the other hand, at its upper part a voluntary shoeing projection (111).

According to the invention, the front end of the sliding piston (6) is held to the body (2) by at least one restraining stub axle (14*a*, 14*b*) , the said stub axle being jointed on the piston (6) by one of its ends, around a first transverse axis (MM'), while the other end is jointed on the body (2) around a second transverse axis (NN').

According to an additional characteristic, the restraining stub axle is jointed on the piston around an axle (12) embodying the first transverse axis (MM') which also acts as the joint for the loosening lever. According to the first method of achievement illustrated in FIGS. 1 to 14, the sliding piston (6) includes two lateral restraining stub axles (14*a*, 14*b*) laterally arranged on either side of the said piston (6) between the said piston and the interior side walls of the housing (10) achieved in the body for the transfer of the piston. Thus, the piston includes a left stub axle (14*a*) and right stub axle (14*b*). Each stub axle is jointed by its upper end (141) on the piston around the axle (12) also permitting the pivot of the loosening lever, while its lower end (142) is jointed on the lower front part (21) of the body (2) around a transverse axle (15) embodying the second transverse axis (NN'). Thus, each stub axle which is achieved in steel sheet includes at its upper end (141) a first hole (120) intended to receive the transverse axle (12) and at its lower end (142) a second hole (150) intended to receive the lower pivotal transverse axle (15). Each restraining stub axle is housed in the corresponding side release (68*a*, 68*b*) defined in the front part of the piston (6).

Figure 13:
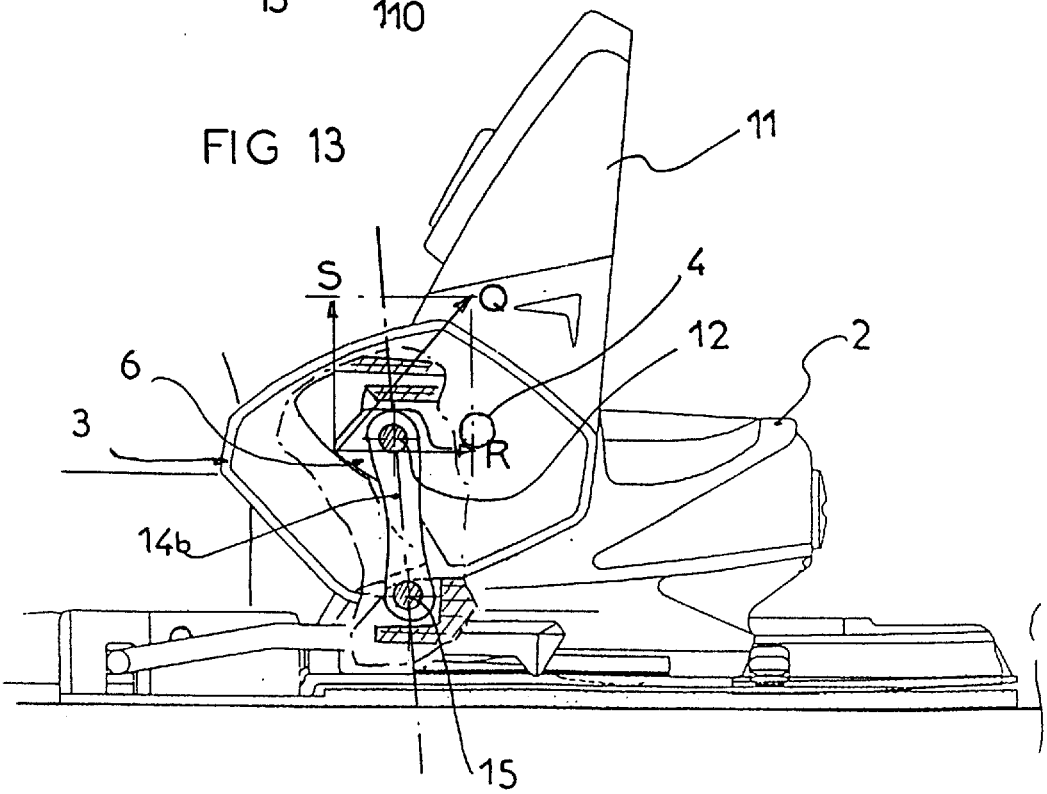
Figure 13A:
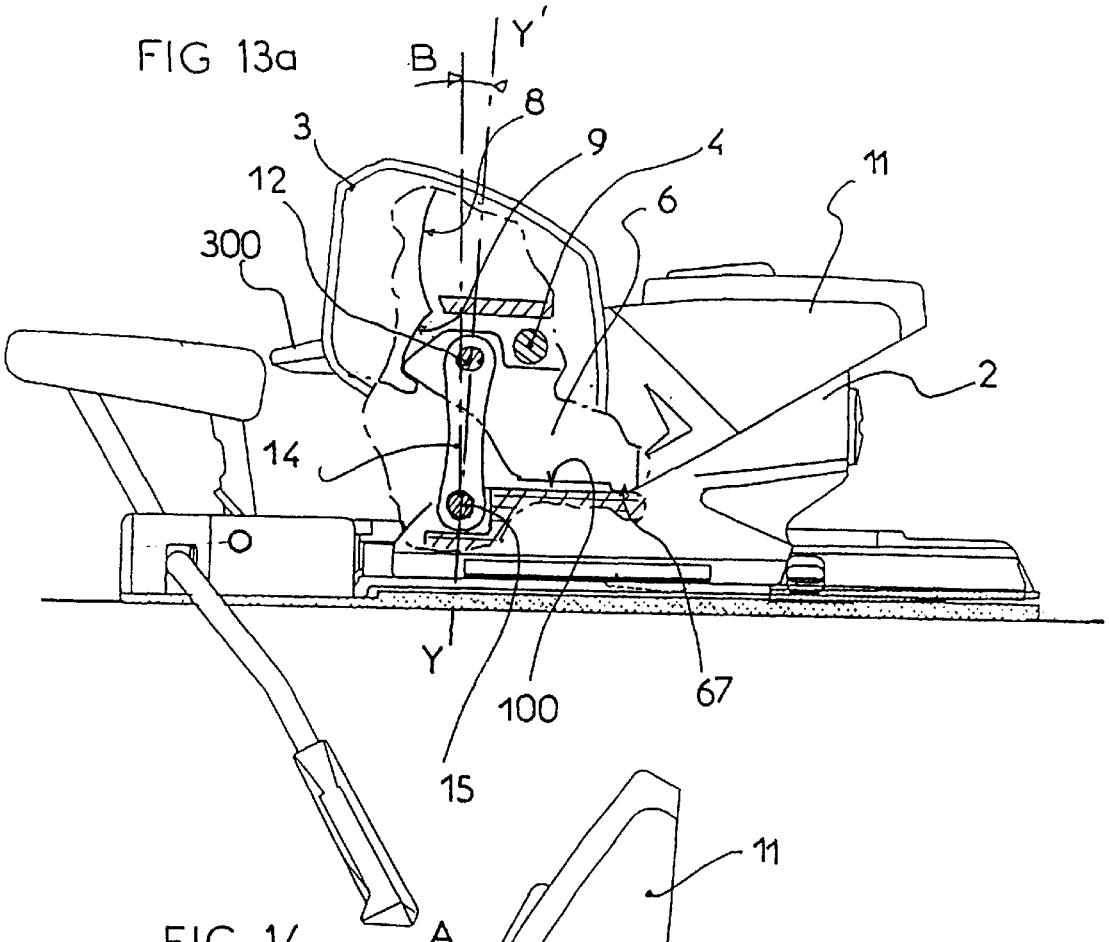
Figure 14:
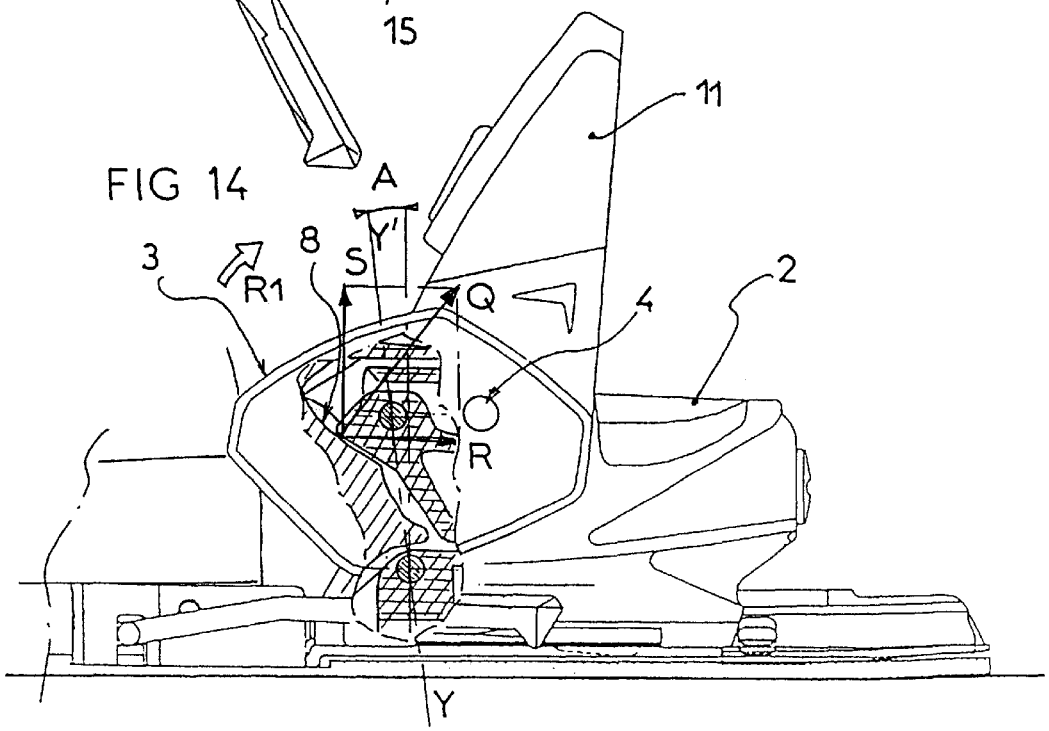
Figure 15:
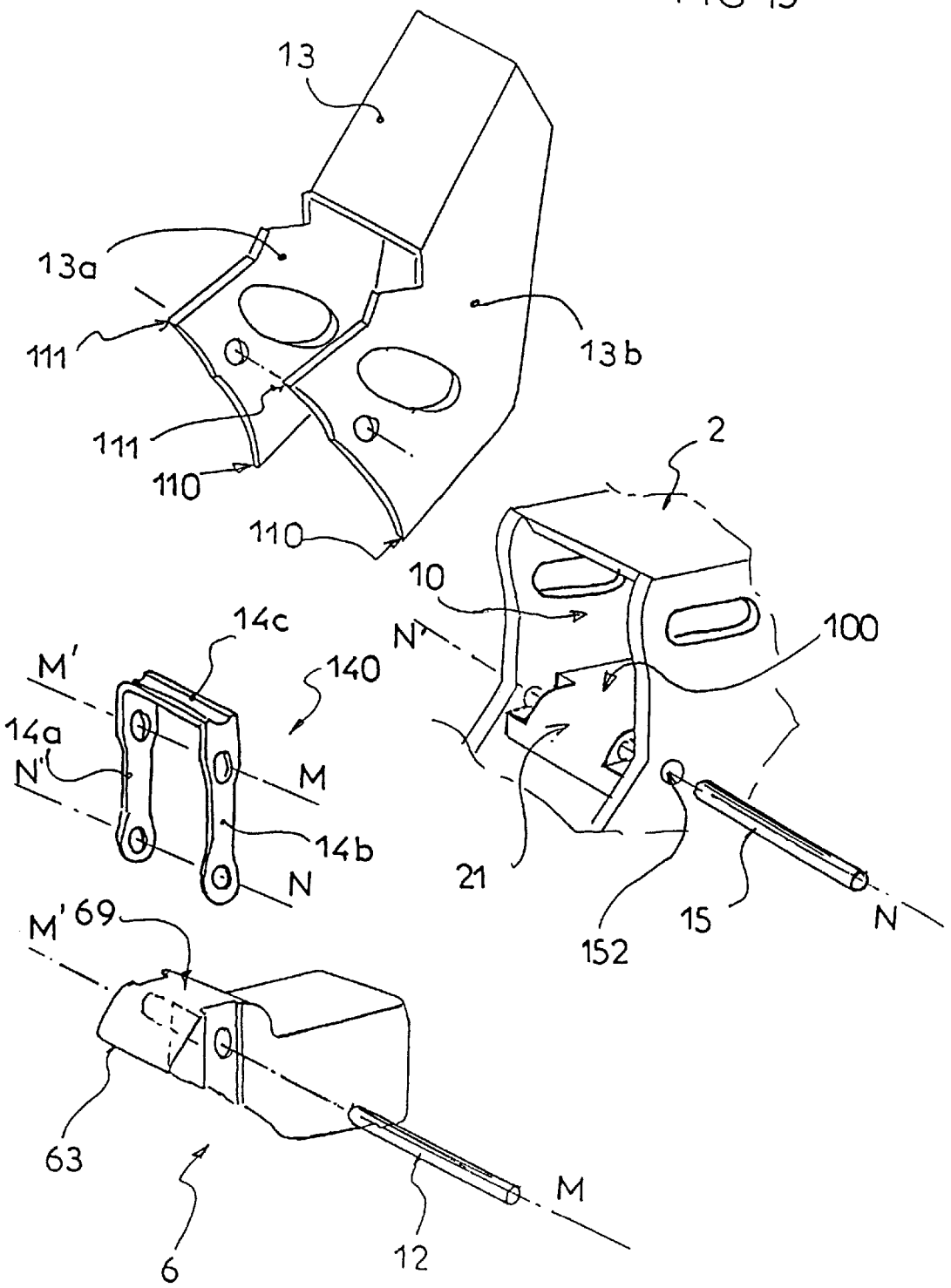
FIGS. 15 to 20 illustrate a variation of the embodiment according to which the restraining stub axles are connected at their upper parts by a restraining cross-piece.
Figure 16:
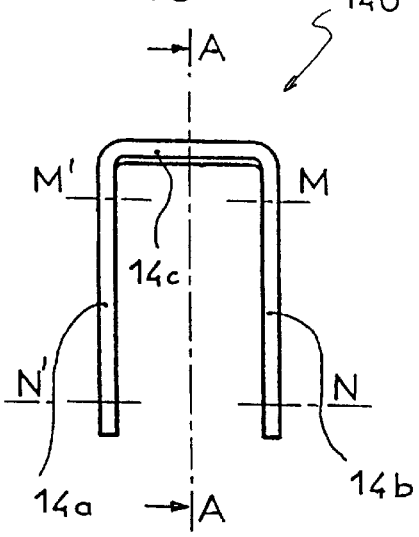
Figure 17:
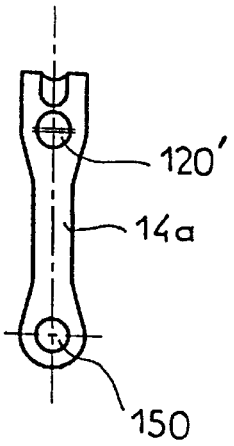
Figure 18:
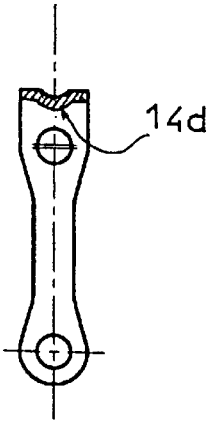

The general axis (YY') of each stub axle joining the centers of the two axles (12, 15) extends approximately vertically to be advantageously in the shoeing position of the binding (FIGS. 2, 5 and 13), the axle sloped slightly forwards (AV) and towards the top (HA) to form an acute angle (A) with the vertical, while in an open position (FIGS. 1 and 13*a*), the axis (YY') is sloped slightly towards the rear (AR) and towards the top (HA) to form an acute angle (B) with the said vertical. Advantageously, the angle (A) is approximately equal to the angle (B) so that during the rotation of the jaw, the pivotal axle (12) moves only slightly in height.

During safety release, the jaw (3) prompted by the heel of the boot pivots towards the top according to R1 around its axle (4) . During this movement, the release ramp (8) urges the piston according to stress Q which breaks down into two orthogonal stresses, a stress vertically directed toward the top (S) and a stress horizontally directed toward the rear (R). The action of the ramp on the piston (6) then causes the piston's sliding longitudinal movement towards the rear against the action of the spring (7). During its sliding longitudinal movement, the piston presses its projection (67) on the lower surface (100) of the sliding housing (10), the said rejection (67) being moved towards the rear on its lower support surface (100). Furthermore, the stub axles hold the front of the piston to ensure its restraint toward the top and to thus receive the vertical stress (S) directed toward the top which was applied on the said piston by the ramp (8) of the jaw (3).

According to an additional characteristic of the invention, recall that the loosening lever (11) is advantageously jointed on the piston (6) around the axle (12) also acting as the pivotal axle of the restraining stub axles.

Figure 19:
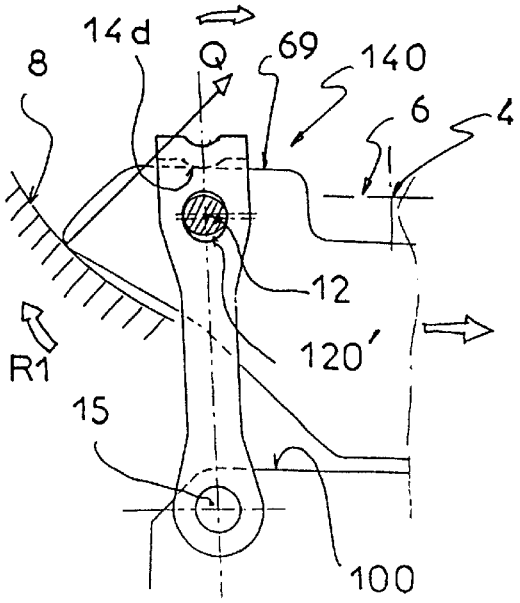
Figure 20:
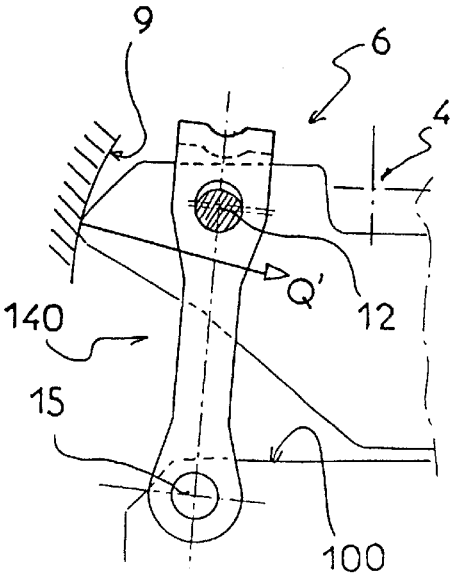

FIGS. 15 to 20 illustrate a variation of the embodiment according to which the two lateral restraining stub axles (14*a*, 14*b*) are connected by their upper end by a cross-piece (14*c*) to form a restraining stirrup (140) having the shape of a U open towards the bottom. In this embodiment, the upper cross-restrain (14*c*) is intended to restrain the piston (6) towards the top, when the boot is held on the ski, and during a safety release by pulling toward the top of the boot. In this manner, the cross-piece (14*c*) includes a projection (14*d*) extending transversely toward the base on which the upper surface (69) of the front of the piston (6) comes to be pressed in the previously stated positions, that is, when the boot is held on the ski and during safety release. Furthermore, each lateral stub axle (14*a*, 14*b*) includes a hole (120') which is slightly oblong permitting, on one hand, the passage of the axle (12) of the lever (11) and, on the other hand, the relatively vertical movement of the said axle, during the operation of the binding (such as is illustrated in FIGS. 19 to 20). FIG. 19 schematically and partially illustrates the binding during a safety release. During this movement, the jaw (3) is prompted towards the top by the boot and pivots according to R1 around its axle (4). During this pivotal movement, the release ramp (8) prompts the nose (63) of the piston towards the top, which causes a slight upthrust of the front of the piston which is lifted up until its upper surface (69) is pressing on the cross-piece (14*c*). One finds oneself, moreover, in this situation when the binding is in its position of shoeing and restraining the boot.

FIG. 20 schematically and partially illustrates the binding in the position corresponding to that where the jaw (3) is open, ready to be shoed, also corresponding approximately to that of the binding during an automatic shoeing by pressing the boot on the pedal (300). During this movement, the lower ramp (9) then prompts the nose of the piston towards the base, which causes a slight movement of the front of the piston towards the base which is moved until the axle (12) is pressing against the lower peripheral edge of the hole (120').

FIG. 21 is a drawing in perspective showing another variation of the embodiment according to which the piston (6) only includes one single restraining stub axle (14).

One has previously seen that each stub axle (14*a*, 14*b*, 14) or the like, like the stirrup (140), is jointed and pivotally held on the body (2) around an axle (15) which is inserted in a corresponding transverse hole (152) achieved in the lower front part of the body. However, all other types of arrangements of holding the stub axles could be adapted like, for example, those illustrated in FIGS. 22, 23, 24 and 25. These figures illustrate two variations of operation according to which the two lateral restraining stub axles are connected by their lower end (142) by a lower restraining and pivoting cross-piece (14*e*) which is constituted by a cylindrical shape intended to be inserted in the transverse housing (210) achieved in the lower front part (21) of the body forming a sort of restraining and pivoting hook, the cooperation between the lower cross-piece (14*e*) and the transverse housing (210) thus defining the second transverse axis (NN').

Figure 24:
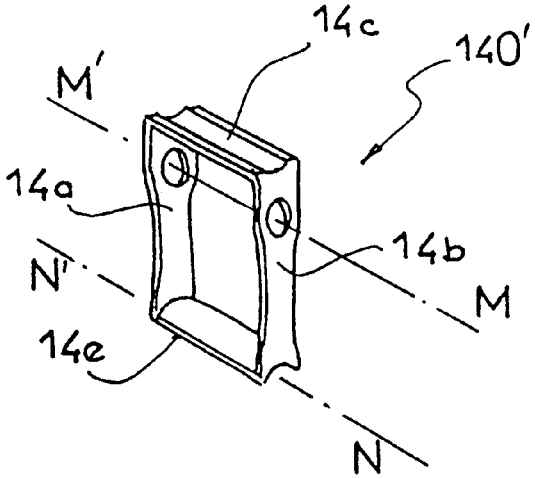
FIGS. 24 and 25 are views illustrating another variation.
Figure 25:
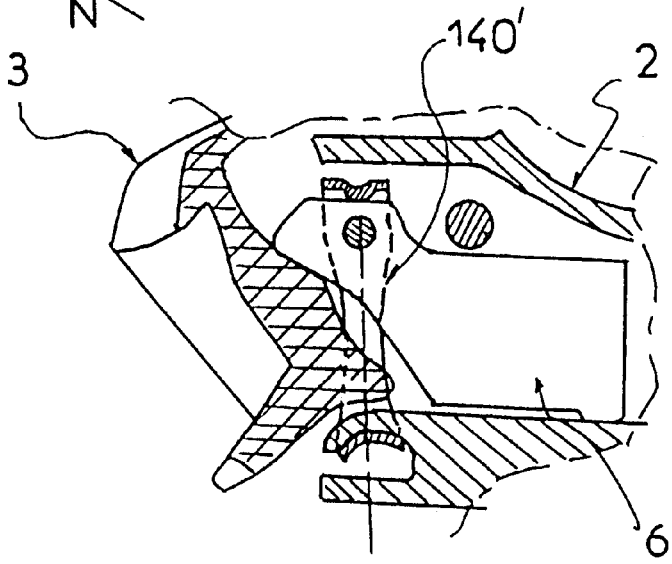

FIGS. 22 and 23 illustrate a first variation according to which the two lateral stub axles are not connected by their upper ends, while FIGS. 24 and 25 illustrate a second variation according to which the restraint of the piston is achieved by a stirrup (140') of a type like that achieved in FIGS. 15 to 20.

Figure 26:
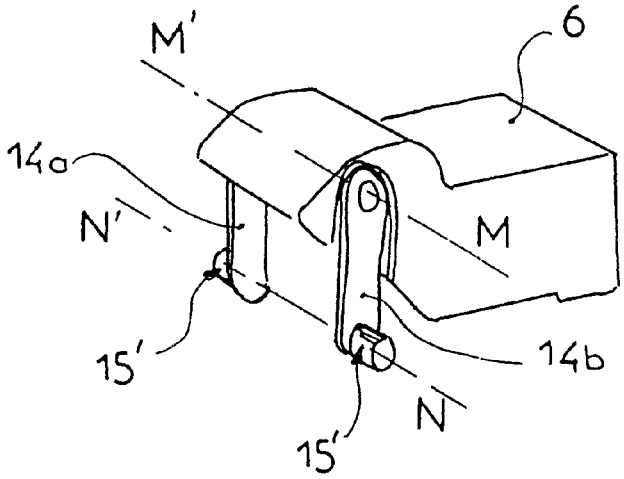
FIG. 26 illustrates, in perspective, another possible way of achieving the restraining stub axles.

FIG. 26 is a drawing in perspective of another possible way to achieve the pivot of the stub axles. According to this variation, each stub axle includes a lower projection (15') intended to be inserted in a hole which is achieved in the wall of the body, thus defining the second transverse axis (NN') with the said stub axles (14*a*, 14*b*).

Note that, like that which is known, the body (2) of the binding is slidably mounted on a slide (51) attached to the ski to permit, on one hand, a precise adjustment of its operative position to the length of the boot of the user and, on the other hand, its movement against the action of one or many springs (52). Furthermore, the binding according to the invention advantageously includes a retractable ski brake (70).

It is well understood, the invention is not limited to the methods of achievement described and shown herein as examples, but rather the invention includes all technical equivalents as well as their combinations.

I claim:

1. A binding for holding a boot in a releasable manner to a ski including:

a jaw pivotally mounted on a body around a transverse axle, the jaw being movable from a closed position to an open position and vice versa, a jaw being restrained in a closed position by a biasing system;

a loosening lever pivotally movable from (i) a position where it extends toward the top, corresponding to the closed position of the jaw, to (ii) a position in which it extends towards the rear, corresponding to the open position of the jaw;

the biasing system including:

a piston which is longitudinally movable and biased to press yieldingly on a ramp defined in the jaw, and at least one restraining stub axle jointed with the body at its lower end to pivot around a lower transverse axis and pivotally jointed at an upper end thereof to pivot around an upper transverse axis on a front part of the piston to limit upward movement of the piston.

2. The binding according to claim 1 wherein the biasing system includes two lateral restraining stub axles located laterally on either side of the piston.

3. The binding according to claim 1 wherein a central axis of each stub axle which joins centers of the upper and lower transverse axes extends approximately vertically, (i) when the binding is in the closed position, the stub axle being sloped slightly forward and towards the top to form an acute angle with the vertical, and (ii) when the binding is in the open position, the stub axle is sloped slightly backward and towards the top to form an acute angle with the vertical.

4. The binding according to claim 3 wherein two lateral stub axles are arranged in side recesses defined in side walls of the piston.

5. A binding for holding a boot in a releasable manner to a ski, the binding including:

a jaw mounted on a body for pivotal movement around a transverse axis from a closed position to an open position and vice versa;

a biasing system including:

a piston which presses on a cam surface defined on the jaw to bias the jaw to the closed position, two lateral restraining stub axles which are pivotally connected at lower ends with the body and are connected at their upper ends by a cross-piece to form a restraining stirrup having the shape of a U open towards the lower ends, the cross piece restraining the piston toward the top;

a loosening lever pivotally movable relative the piston so the loosening lever is movable (i) from a position extending toward the top, corresponding to the closed position of the jaw, (ii) to a position where it extends towards the rear, corresponding to the open position of the jaw.

6. A binding for holding a boot in a releasable manner to a ski or the like including a jaw pivotally mounted on a body to pivot around a transverse axis in such a way that the jaw is movable from a closed position to an open position and vice versa, the jaw being restrained in a closed position by a biasing system, the binding further including a loosening lever pivotally movable (i) from a position in which it extends toward the top, corresponding to the closed position of the jaw, (ii) to a position in which it extends towards the rear, corresponding to the open position of the jaw, the biasing system including a piston which is longitudinally movable and spring biased to press on a ramp defined in the jaw wherein:

at least one restraining stub axle is pivotally jointed with the body at its lower end to pivot around a lower transverse axis and pivotally jointed to the piston at its upper end by an upper transverse axle, the loosening lever being pivotally jointed to the piston around the upper transverse axle.

7. The binding according to claim 6 in which the upper end of the at least one restraining stub axle includes an oblong hole for the passage of the transverse axle.

8. A binding for releasably holding a boot to a ski, the binding including:

a jaw pivotally mounted on a body around a transverse axis making the jaw movable between a closed position and an open position;

a biasing system for releasably retaining the jaw in the closed position, the biasing system including:

a piston having a rear part having a central bore for receiving a biasing spring, the central bore extending towards a front part which has a transverse support nose for cooperatively engaging a ramp of the jaw, at least one restraining stub axle restraining the piston towards its top and pivotally jointed with the body at its lower end;

a loosening lever pivotally movable between (i) a position where it extends toward the top, allowing the spring to move the piston forward and (ii) a position where it extends towards the rear, urging the piston rearward against the spring.

9. The binding according to claim 8 wherein the front part of the piston includes an upper transverse projection defining a transverse hole which receives a transverse axle to which the at least one restraining stub is connected.

10. The binding according to claim 8 wherein the rear part is approximately a parallel-piped and has an inner wall which includes at its end a transverse support projection which presses slidably on an inner surface of a support for the housing in which the piston moves.

11. A binding for releasably holding a boot to a ski, the binding comprising:

a body which is connected to the ski;

a jaw which is pivotally mounted to the body for pivoting movement relative to a transverse axis, the jaw being pivotally movable between a closed, boot engaging position and an open, boot releasing position;

a biasing system for releasably biasing the jaw into the closed position, the biasing system including:

a piston slidably mounted within the body for movement toward and away from sloping ramp surfaces on the jaw, and, a spring which biases the piston against the ramp surfaces; and, an over-center restraining stub which is pivotally connected with the body at its lower end and pivotally connected with the piston at its upper end, the restraining stub being pivoted to an acute angle forward of vertical when the jaw is in the closed position and being pivoted to an acute angle rearward of vertical when the jaw is in the open position, the restraining stub moving through vertical as the jaw moves between the open and closed positions;

a lever pivotally mounted relative to the piston and the stub for mounting the stub between the acute angle forward of vertical and the acute angle rearward of vertical.

* * * * *